US005845574A

United States Patent [19]

Dilling et al.

[11] Patent Number: 5,845,574

[45] Date of Patent: Dec. 8, 1998

[54] INK TRANSPORT ROLLER FOR THE INKING UNIT OF A WEB FED ROTARY PRINTING MACHINE AND PROCESS FOR ITS PRODUCTION

[75] Inventors: Peer Dilling, Friedberg; Othmar Dax, Diedorf; Wolfgang Pilath, Ammersbeck, all of Germany

[73] Assignee: MAN Roland Druckmaschinen AG, Offenbach am Main, Germany

[21] Appl. No.: 895,306

[22] Filed: Jul. 16, 1997

[30] Foreign Application Priority Data

Jul. 16, 1996 [DE] Germany ..... 196 28 647.6

[51] Int. Cl.[6] ..... B41F 31/00

[52] U.S. Cl. ..... 101/351.6; 101/206; 101/375; 101/352.01

[58] Field of Search ..... 101/351.06, 349.1, 101/352.01, 205, 206, 207, 209, 208, 375

[56] References Cited

U.S. PATENT DOCUMENTS

| | | | |
|---|---|---|---|
| 86,263 | 1/1869 | Wells | 101/351.6 |
| 333,490 | 12/1885 | Underwood | 101/208 |
| 2,154,896 | 4/1939 | Gibb | 101/348 |
| 3,910,186 | 10/1975 | D'Amato et al. | 101/156 |
| 5,189,960 | 3/1993 | Valentini et al. | 101/487 |
| 5,406,886 | 4/1995 | Schneider et al. | 101/349 |
| 5,632,203 | 5/1997 | Voeltner et al. | 101/348 |

FOREIGN PATENT DOCUMENTS

| | | |
|---|---|---|
| 875 205 | 7/1949 | Germany . |
| 27 45 086 | 4/1979 | Germany . |
| 90 05 141.6 | 7/1991 | Germany . |
| 19 502 475 | 8/1996 | Germany . |
| 19 510 797 | 9/1996 | Germany . |
| 55-74 53 | 1/1980 | Japan . |
| 236 105 | 9/1987 | United Kingdom . |

*Primary Examiner*—Edgar Burr
*Assistant Examiner*—Dave A. Ghatt
*Attorney, Agent, or Firm*—Cohen, Pontani, Lieberman & Pavane

[57] ABSTRACT

An ink transport roller (1) which may be used universally for panorama printing and printing of multiple colors next to one another. The roller has a recess (2) in an area between the colors which may be optionally opened or closed depending upon whether the roller is to be used for printing multiple colors next to one another or panorama printing, respectively.

20 Claims, 7 Drawing Sheets

FIG. 5
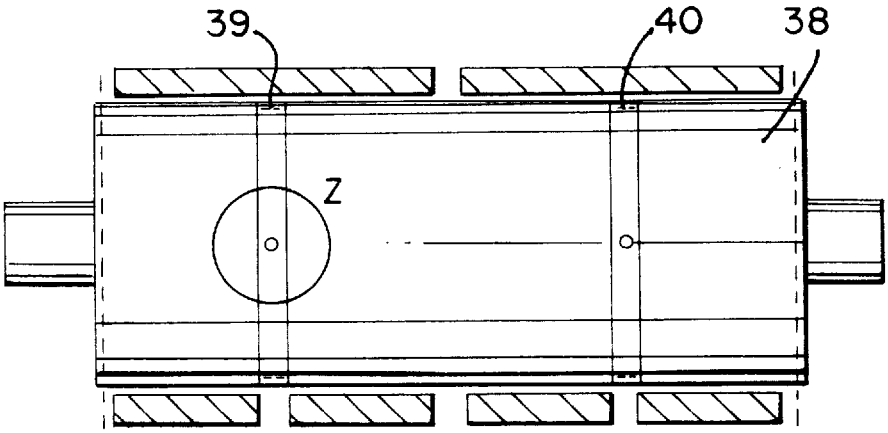
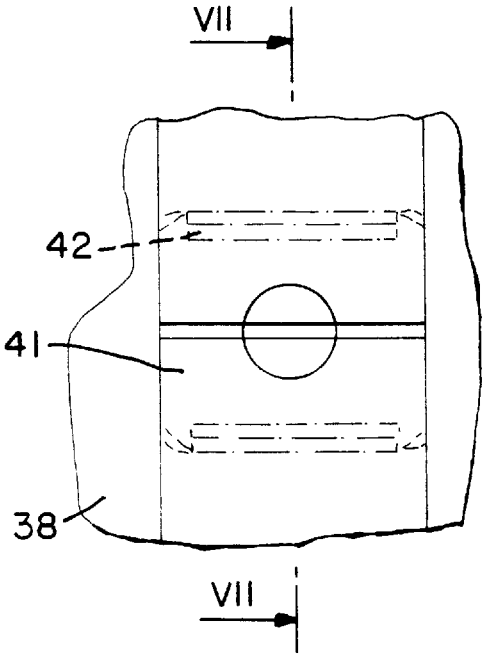
FIG. 6
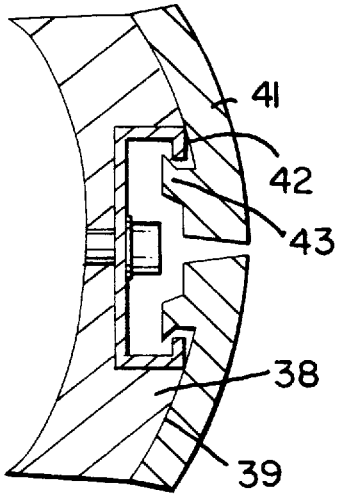
FIG. 7

INK TRANSPORT ROLLER FOR THE INKING UNIT OF A WEB FED ROTARY PRINTING MACHINE AND PROCESS FOR ITS PRODUCTION

BACKGROUND OF THE INVENTION

1. Field of the Invention

The present invention relates to an ink transport roller, such as an inking roller, application roller or friction cylinder, for an inking unit of a web-fed rotary printing machine, which may be switched between panorama printing and printing multiple colors next to one another, and a process for producing the same.

2. Description of the Related Art

Panorama printing refers to printing an image across two pages of a newspaper without interrupting the image. A printing machine that is four pages wide is thus able, during panorama printing, to print two panorama images, each of which extends across two pages. An unprinted white edge remains between these panorama pages. When a printing group is converted from panorama printing to printing four colors next to one another or vice versa, conversion work of different sorts must be performed on the inking unit, depending on its design. For example, inking rollers and application rollers may be constructed so as to have recesses next to one another for separating the different colors. These recesses are depressions in the rubber covers of the rollers in the region of the unprinted white edge of the printed product. Normally, when four colors are printed next to one another, three recesses are needed between the colors. During panorama printing, only one recess is needed in the area between the two panorama pages. During conversion from one type of production to the other, the application and inking rollers must therefore be changed. This is time consuming, especially since the change requires readjustment. Furthermore, the exchange of rollers is complicated and strenuous work, since the rollers can weigh up to 100 kg. These problems also arise in the case of machines that are two pages wide, i.e., printing machines that can print one panorama page.

The object of the invention, therefore, is to create a universally usable ink transport roller for an inking unit that may be switched between panorama printing and printing four colors next to one another. Furthermore, the object is to create a process to produce an ink transport roller according to the invention.

SUMMARY OF THE INVENTION

This object is attained according to the invention in a generic ink transport roller comprising an ink transport roller having a circumferentially defined recess which is operatively closable and openable so as to optionally switch between panorama printing and printing of multiple colors next to one another. The invention further comprises a mechanical gear for moving said elastic tube into and out of the encircling recess. During panorama printing, the invention closes the disruptive recesses of the inking transport roller. As a result, there is no need to exchange or readjust ink transport rollers. Conversion to the other type of production may therefore be carried out relatively quickly and inexpensively.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein like reference numerals denote similar elements throughout the several views:

FIG. 5 shows a friction cylinder with closable recesses;

FIG. 6 shows an enlarged view of area Z of FIG. 5;

FIG. 7 shows a cross-sectional view along line VII—VII of FIG. 6;

DETAILED DESCRIPTION OF THE PRESENTLY PREFERRED EMBODIMENTS

Figure 1:
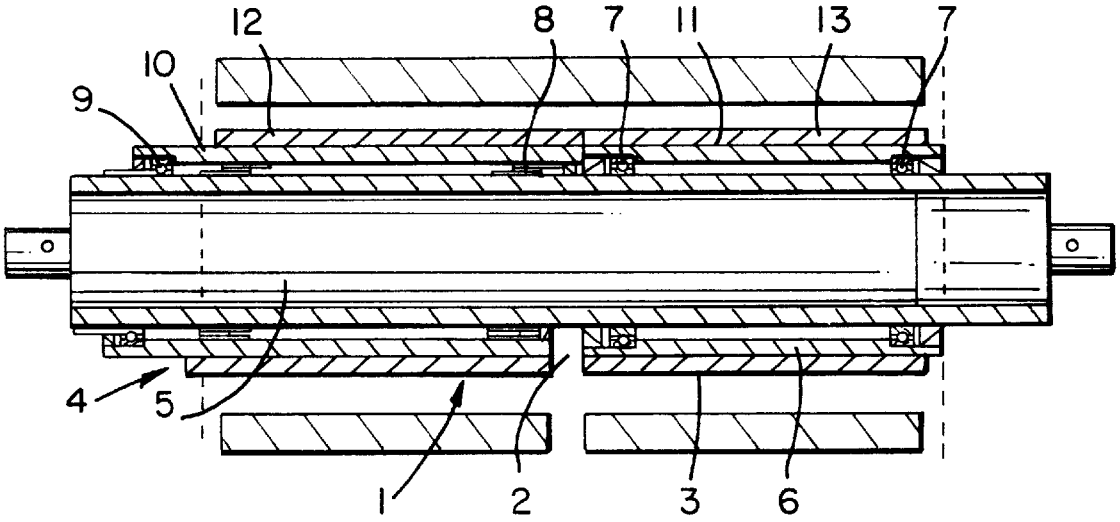
FIG. 1 shows a cross-section view of an inking roller in accordance with the present invention with a movable cylindrical surface region.

FIG. 1 shows an inking roller 1 for transferring ink in an inking unit of a printing machine. Other rubber rollers, for example, application rollers, could be constructed in the same manner. The inking roller 1 is designed for a single-wide printing machine, that is, a printing machine two pages wide. In the center, the ink transport roller 1 has a recess 2, which divides the cylindrical surface 3 into two parts. One part is mounted as a rotatable and movable sleeve 4 on the core 5 of the inking roller 1; the other part 6 of the cylindrical surface is mounted only rotatably on the core 5, for example, with deep-groove ball bearings 7. Sleeve 4 is mounted to core 5 by a needle bearing 8 and a deep-groove ball bearing 9. The needle bearing 8 provides a degree of axial freedom. Axial fixing in place is provided by the deep-groove ball bearing 9 which may be axially moved and fixed in the required axial position. For this purpose, a deep-groove ball bearing, for example, is suitable, the inner ring of which may be fixed in place by means of a threaded pin such as the bearing series YAR of a roller bearing manufacturer. The sleeve 4, like the part 6, comprise a carrier sleeve 10, 11, with an elastic layer 12, 13.

For panorama printing, the sleeve 4 is placed onto the immovable part 6 of the cylindrical surface 3, as shown in the upper part of the sectional view in FIG. 1. For printing with two colors next to one another, the sleeve 4 is moved back, so that a recess 2 is formed, as shown in the lower part of FIG. 1. The corresponding inking is indicated schematically above and below the inking roller 1.

The inking roller 1 shown in FIG. 1 may alternatively be constructed in a doubled fashion next to one another on one roller for use in double-wide machines, that is, for machines that print two panorama pages or four colors next to one another. Rollers for machines are shown in the following examples. On the other hand, when a closable recess area is omitted, these rollers may also be used for single-wide machines. The principle is also be applicable for friction cylinders, in which case the carrier sleeves 10, 11 carry an oleophilic layer, for example, of copper. A slide bearing may be used for the sleeve 4 as well as the immovable part 6 of the cylindrical surface.

Figure 2A:
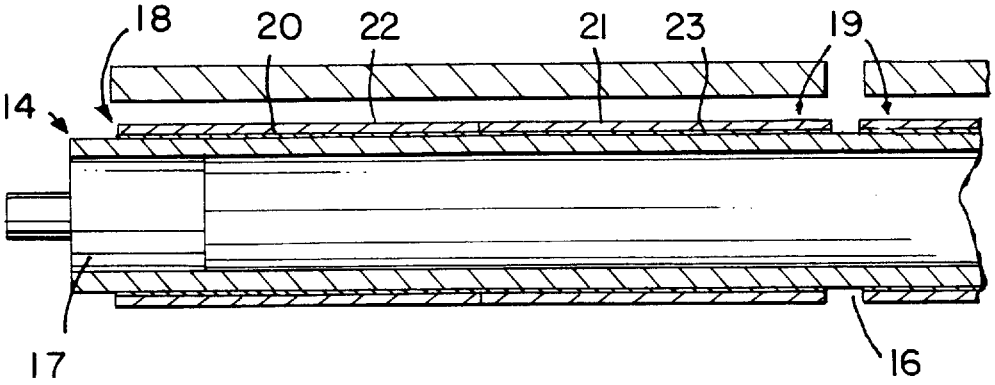
FIGS. 2A & 2B show a cross-sectional view of a friction cylinder in accordance with the present invention with movable cylindrical surface regions.
Figure 2B:
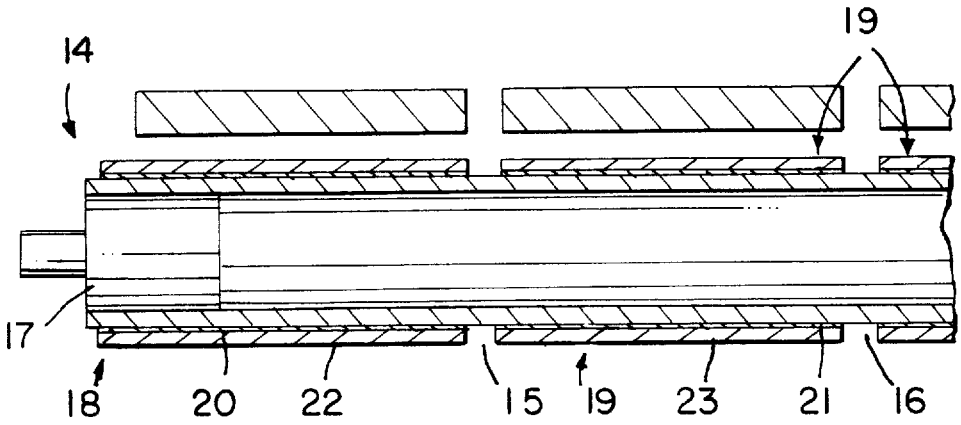

FIG. 2B shows a friction cylinder 14 with two closable recesses 15. The friction cylinder 14 is shown only as a half-side; it extends over two panorama pages or four single pages. In the center, that is, in the area between the two panorama pages, the cylinder 14 has a third recess 16, which, in certain cases is not necessary such as when the application rollers work together with the friction cylinder 14 and are equipped with a recess in the area between the panorama pages. On both sides of the recess 15, that is, in the area of the two colors to be printed next to one another, the core 17 carries two sleeves 18, 19 via a sliding seat for movably mounting the sleeves to the core, each of the sleeves consists of a carrier sleeve 20, 21 with an oleophilic covering, primarily a copper layer 22, 23, however, the layer may also be made of Rilsan or PA 11. The carrier sleeve 20, 21 is preferably a galvanized nickel tube, and alternatively may be welded or wound of relatively thin-walled sheet metal or may be formed of glass-fiber or carbon-fiber reinforced plastic. The second half (not shown) of the friction cylinder 14 is similarly constructed.

In the state shown in FIG. 2B, the friction cylinder 14 is used to print four colors next to one another, as indicated schematically above the friction cylinder 14. For panorama printing, the outer sleeves 18 are placed over the recesses 15, as shown in FIG. 2A. A closed cylindrical surface is thus obtained for each panorama page, as shown schematically above the friction cylinder 14. To move the sleeve 18, an air cushion is established between the sleeve 18 and the core 17. The design of such a cylinder for the purpose of moving a tube located on the cylinder is known and need to be described further. The inner sleeves 19 are also mounted by means of such an air cushion. After deflation of the air cushion, the sleeves 18, 19 are securely seated in a friction-locking manner. The principle of sleeve movement illustrated in FIGS. 2A & 2B may alternatively be used for inking and application rollers whereby, the carrier sleeves 20, 21 carry elastic layers.

Figure 3:
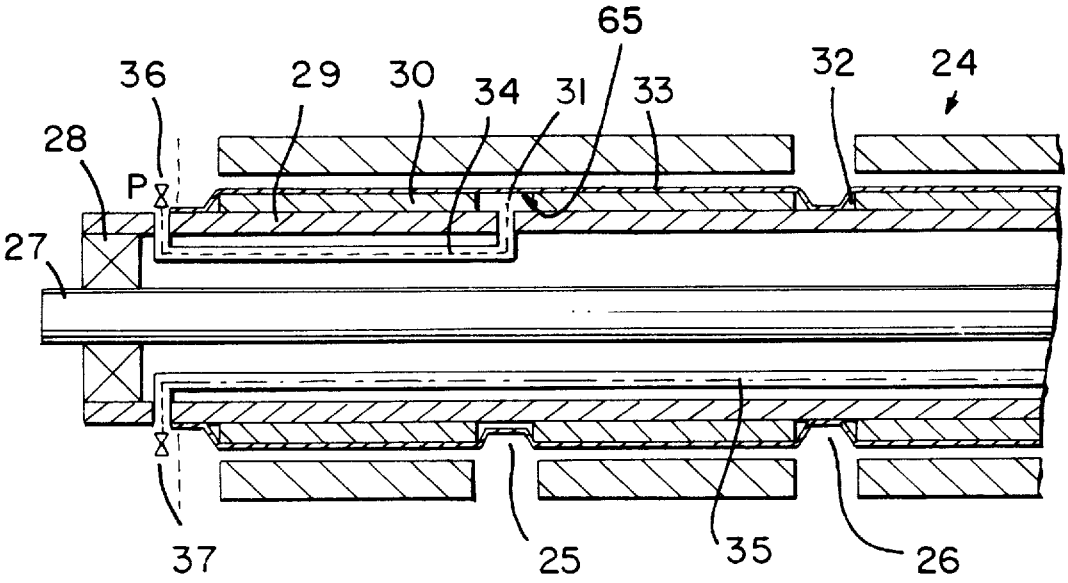
FIG. 3 shows a cross-sectional view of an application roller in accordance with the present invention with tube-covered recesses.

FIG. 3 shows the left half of an application roller 24, which extends across a schematically indicated panorama page. The application roller 24 has a recess 25 approximately in the center of each panorama page (or in the area between two colors to be printed next to one another, as the case may be, instead of approximately in the center of the panorama page), as is schematically indicated below the application roller 24. Furthermore, the application roller 24 has a recess 26 approximately in the center, that is, in the region between the two panorama pages. The application roller 24 contains an axle 27, on which a core 29 is rotatably mounted by means of roller bearings 28. The core 29 carries an elastic layer 30, for example, a rubber layer, into which the encircling recesses 31, 32 are worked. The elastic layer 30 and the recesses 31, 32 are covered by an elastic tube 33, for example, a rubber tube, which is placed into the recesses 31, 32. From the recesses 31 in the center of the panorama pages, the lines 34, 35 lead to an edge of the application roller 24. The lines end with the respective valves 36, 37 with pressurized air ports. The pressurized air ports may be embodied in the form of automatic valves containing spring-loaded cone valves.

For panorama printing, the recesses 31 are placed under a defined overpressure p. As in an automatic gear, the valves 36, 37 are subjected to a given pressure from a pressurized container. The elastic tube placed into the recesses 31 is thereby moved out of the latter onto the level of the tube on the elastic layer 30. In the area of the recesses 31, the pneumatically blown-off elastic tube 33 has a spring characteristic that resembles that of the further roller area in the region of the elastic layer 30. As a result, similar energy absorption conditions are created, which is important for a relatively long useful life. For conversion to the other type of production, that is, for printing four colors next to one another, the pressure in the recesses 31 is substantially or completely eliminated, as a result of which the tube 33 is placed into the latter and the recesses 25 are formed, as shown in the lower half of the application roller 24. The evacuation of pressurized air is realized in an uncontrolled manner by opening the valve cone, for example, with one finger. The application roller shown in FIG. 3 may also be used as an inking roller, provided with suitable embodiments of the elastic layer 30 and the elastic tube 33. Depending on the particulars of the inking unit, the recess 26 may also be omitted.

Figure 4A:
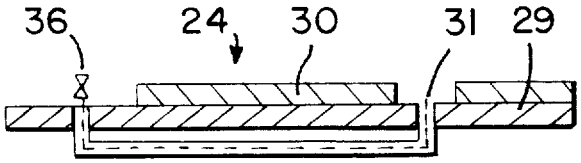
FIG. 4A–4D show the steps for producing the application rollers of FIG. 3.
Figure 4B:
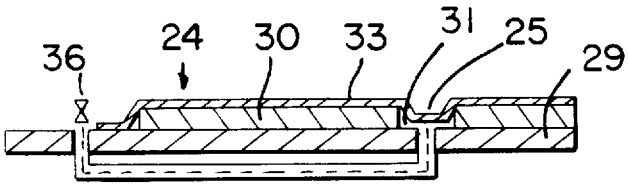
Figure 4C:
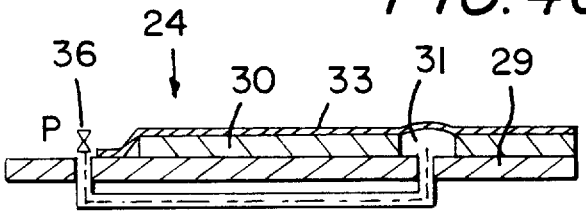
Figure 4D:
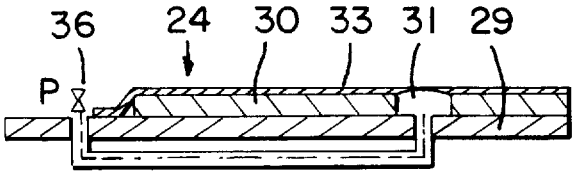

FIGS. 4A through 4D show the process steps for manufacturing the application roller 24 of FIG. 3. In each case, only a section of the application roller 24 is shown. First, as shown in FIG. 4A, an elastic layer 30 such as a rubber layer is placed on the core 29 of the application roller 24. Thereafter, the elastic layer 30 is smoothed over and the encircling recess 31 is created. Then, as shown in FIG. 4B, an elastic tube 33 is placed onto the elastic layer 30, for example, a rubber tube is vulcanized or stuck onto the layer 30 or a shrinkage tube is shrunk on with heat. The elastic tube is thereby inserted into the recess 31. The activation force provided during the subsequent use of the application roller 24 then moves the elastic tube 33 out of the recess 31; specifically, pressurized air is applied at the valve 36 at a certain defined pressure p as shown in FIG. 4C. Finally, in FIG. 4D, the elastic tube 33 is smoothed over on the entire cylindrical surface of the application roller 24, and the functional area of the application roller 24 is thus brought to approximately the same level.

For the removal of the elastic layer 30 from the recess 31, other operating mechanisms are also possible. For example, instead of using a gaseous pressure medium, it is possible to use a liquid medium. In addition, piezo-translators may be arranged in the recess 31 which remove the elastic tube 33 when activated. Mechanical operating means may also be used. For instance, working cylinders or electric magnets, which remove the tube 33 directly or via gears, may be arranged in the core 29 in the area of the recess 31. It is also possible, for example, for the elastic tube 33 to carry a conductive layer 65 on the side facing the recess 31, by which an electrostatic force is produced which moves the tube 33 out of the recess 31.

FIG. 5 shows a friction cylinder with two recesses 39, 40, each of which is arranged approximately in the center area of a panorama page. As shown in FIGS. 6 and 7, the recesses 39, 40 may be closed with strips 41 of an oleophilic material. For this purpose, a clamp 42, in which the strip 41 is suspended, is screwed into each recess 39, 40. The strip 41 is an oleophilic plastic such as Rilsan or polyurethane. For assembly, a plastic strip of this type is heated in a water bath, whereby the strip expands. The strip may then be easily placed into the recesses 39, 40 and suspended by its projections 43 in the clamp 42. Upon cooling, the strip 41 becomes taut. The strips 41 are preferably substantially similar in their material properties and surface to the remaining cylindrical surface of the friction cylinder 38. This can be realized, for example, by a steel strip with a copper surface. Such a strip may also be easily clamped over at approximately dead center, even in the cold state. The strips 41 are easy to assemble and disassemble and lie flatly and securely in the recess 39, 40 at normal operating speeds of the friction cylinder 38. With the inserted strips 41, the friction cylinder 38 is ready for panorama printing; after removal of the strips 41, the cylinder 38 serves for printing four colors next to one another.

Figure 8:
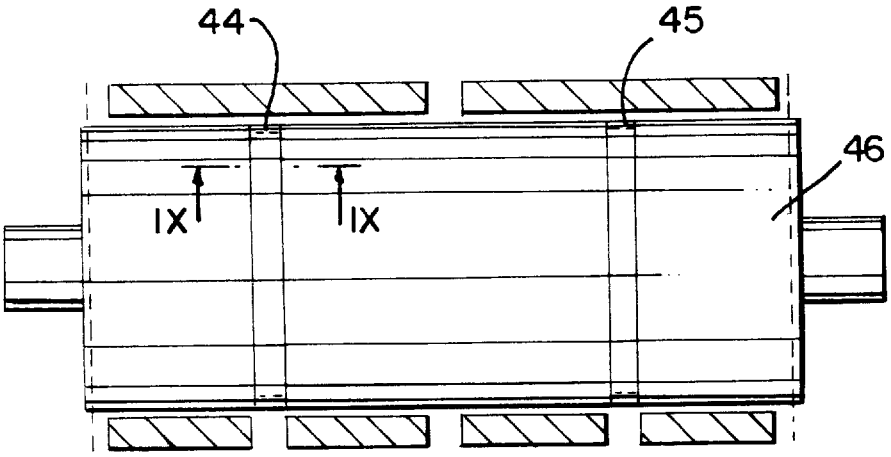
FIG. 8 shows another embodiment of a friction cylinder with closable recesses.
Figure 9:
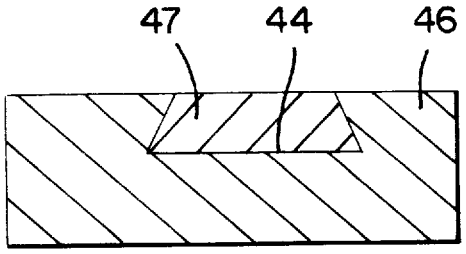
FIG. 9 shows a cross-sectional view along line IX—IX of FIG. 8.

FIG. 8 shows a further possible closing of the recesses 44, 45 in a friction cylinder 46. As shown in FIG. 9, the recesses 44, 45 have a dove-tail or similar guide that acts in a positive-locking manner and reliably holds the correspondingly shaped strip 47. The strip 47 is an elastic material, for example, oleophilic rubber or polyurethane. The friction cylinders 38, 46 (not shown) may also be equipped with a further, non-closable recess in the area between the two panorama pages.

Figure 10A:
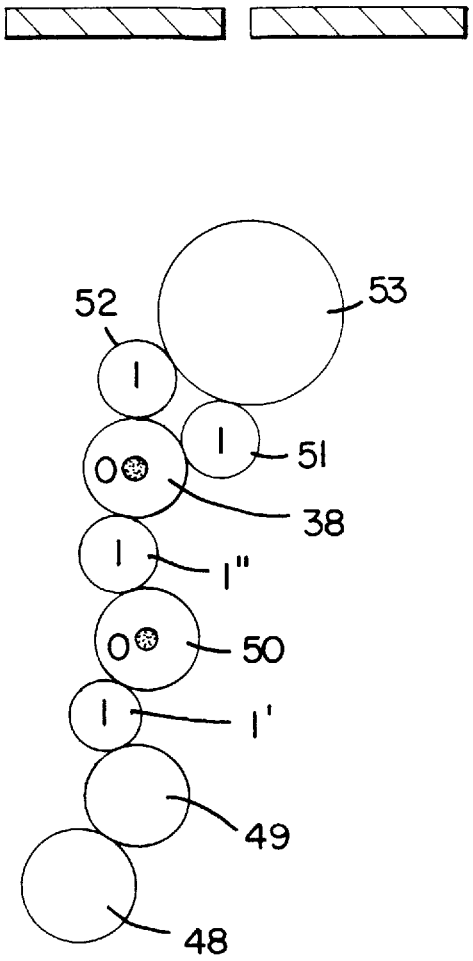
FIGS. 10A & 10B show an inking unit including transport rollers with closable recesses.
Figure 10B:
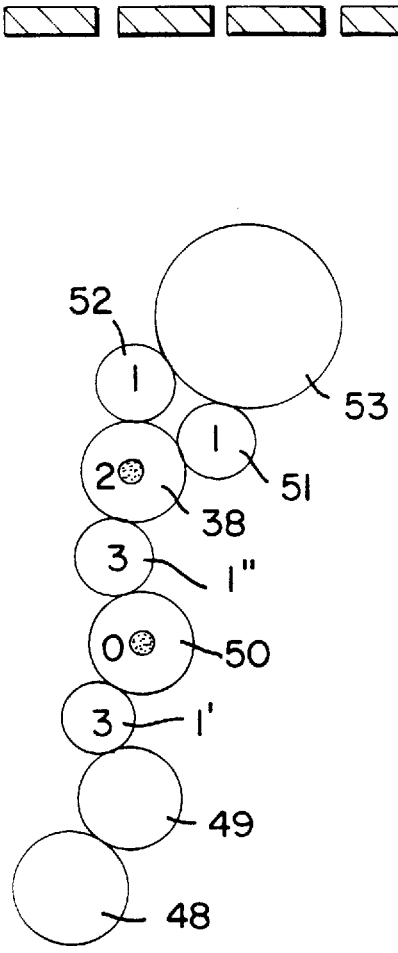

An inking unit for the illustrated use of the different described ink transport rollers with closable recesses is shown in FIGS. 10A and 10B. In FIG. 10A, the inking unit is set for panorama printing. This type of printing is indicated symbolically by the two panorama pages over the inking unit. The ink flow is transported from the ductor 48 via the film roller 49, the inking roller 1', the friction roller 50, the inking roller 1", the printing cylinder 38 and the two application rollers 51, 52 to the form cylinder 53. The inking rollers 1' and 1" are embodied as in FIG. 1, but with two arrangements next to one another (two panorama pages). The reference numbers are provided with ' and " for the sake of differentiation. In these inking rollers 1', 1" the two recesses 2 are closed. The inking rollers 1', 1" show only one recess between the panorama pages. The friction cylinder 38 corresponds to that shown in FIG. 5, with its recesses 39, 40 closed by inserted strips 41. The application rollers 51, 52 have only one central recess between the two panorama pages. In FIGS. 10A & 10B the number of recesses in the rollers is denoted by numbers shown in the rollers.

To convert the inking unit into the version shown in FIG. 10B for printing four colors next to one another (colors are indicated schematically above the inking unit), the sleeves 4 are moved back from the cylindrical surface 3 on the inking rollers 1', 1", so that two recesses 2 are uncovered. In addition, the strips 41 are removed from the recesses 44, 45 on the friction cylinder 8, so that said recesses are thus uncovered. Furthermore, when four colors are printed next to one another, the oscillating stroke of the friction cylinders 46 and 38 is smaller than during panorama printing, so that the four colors located next to one another do not mix with one another.

The described ink transport rollers 1, 14, 24, 38, 46, to the extent that they contain multiple closable recesses 2, 15, 25, 39, 40, 44, 45, also make it possible to close only one part of the recesses 2, 15, 25, 39, 40, 44, 45 and to adjacently perform panorama printing and the printing of individual colors.

Thus, while there have been shown and described and pointed out fundamental novel features of the invention as applied to preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. An inking unit of a web-fed rotary printing machines comprising:

an ink transport roller of constant width having a circumferentially defined recess, and means for selectively opening and closing the recess so as to switch between panorama printing and printing of multiple colors next to one another.

2. The inking unit in accordance with claim 1, wherein said ink transport roller is one of an inking roller and an application roller.

3. The inking unit in accordance with claim 2, wherein said ink transport roller further comprises an elastic cylindrical surface layer coaxially disposed about said ink transport roller.

4. The inking unit in accordance with claim 3, wherein said opening and closing means comprises a cylindrical surface layer divided into two parts by the recess with one of the parts being a sleeve which is axially displaceable over the recess.

5. The inking unit in accordance with claim 4, wherein said ink transfer roller further comprises:

a core about which the sleeve is coaxially disposed; and a sliding seat by which the sleeve is movably mounted to said core.

6. The inking unit in accordance with claim 4, wherein said ink transfer roller further comprises:

a core about which the sleeve is coaxially disposed; and roller bearing in which the sleeve is rotatably and movably mounted to said core of the ink transport roller.

7. The inking unit in accordance with claim 4, wherein said ink transfer roller further comprises a carrier sleeve coaxially disposed about the sleeve having an outer elastic layer.

8. The inking unit in accordance with claim 4, wherein said ink transfer roller further comprises a carrier sleeve coaxially disposed about the sleeve and having an outer oleophilic covering.

9. The inking unit in accordance with claim 1, wherein said opening and closing means comprises a cylindrical surface layer divided into two parts by the recess with one of the parts being a sleeve which is axially displaceable over the recess.

10. The inking unit in accordance with claim 9, wherein said ink transfer roller further comprises:

a core about which the sleeve is coaxially disposed; and a sliding seat for movably mounting the sleeve to said core.

11. The inking unit in accordance with claim 9, wherein said ink transfer roller further comprises:

a core about which the sleeve is coaxially disposed; and roller bearing in which the sleeve is rotatably and movably mounted to said core of the ink transport roller.

12. The inking unit in accordance with claim 9, wherein said ink transfer roller further comprises a carrier sleeve coaxially disposed about the sleeve and having an outer elastic layer.

13. The inking unit in accordance with claim 9, wherein said ink transfer roller further comprises a carrier sleeve coaxially disposed about the sleeve and having an outer oleophilic covering.

14. An inking unit of a web-fed rotary printing machine, comprising:

an ink transport roller having a circumferentially defined recess which is selectively closable and openable so as to switch between panorama printing and printing of multiple colors next to one another, said ink transport roller having an elastic cylindrical surface layer coaxially disposed about said ink transport roller, the elastic layer having an encircling recess defined therein; and an elastic tube disposed about said elastic layer and the encircling recess, said elastic tube being substantially radially displacable into the encircling recess and out of the encircling recess to a point at which said elastic tube is substantially plainer on both sides of the encircling recess.

15. The inking unit in accordance with claim 14, wherein the encircling recess is filled with one of a liquid and a gaseous medium.

16. The inking unit in accordance with claim 15, wherein said ink transport roller further comprises:

a pressurized air port having a valve; and a line connecting said pressurized air port to the encircling recess.

17. The inking unit in accordance with claim 14, wherein said elastic tube has an inner surface facing towards the encircling recess on which is disposed a conductive layer by which an electrostatic force is produced for moving said elastic tube out of the encircling recess.

18. An inking unit of a web-fed rotary printing machine comprising:

an ink transport roller having a circumferentially defined recess which is selectively closable and openable so as to switch between panorama printing and printing of multiple colors next to one another; and a strip of oleophilic material disposed in the recess so as to close the recess.

19. The inking unit in accordance with claim 18, wherein said ink transfer roller further comprises a clamping device disposed in the recess for clamping said strip at its end.

20. The inking unit in accordance with claim 18, wherein the recess and the strip have complimentary shapes so that the strip is held in the recess in a positive-locking manner.

* * * * *